US007946635B2

(12) United States Patent
Canerdy, Jr.

(10) Patent No.: US 7,946,635 B2
(45) Date of Patent: May 24, 2011

(54) DOOR JAMB ENFORCER

(76) Inventor: Aubry L. Canerdy, Jr., Cordova, TN (US)

( * ) Notice: Subject to any disclaimer, the term of this patent is extended or adjusted under 35 U.S.C. 154(b) by 0 days.

(21) Appl. No.: 12/802,808

(22) Filed: Jun. 15, 2010

(65) Prior Publication Data

US 2010/0282138 A1 Nov. 11, 2010

Related U.S. Application Data

(63) Continuation of application No. 11/803,301, filed on May 14, 2007, now abandoned.

(51) Int. Cl.
*E05B 15/02* (2006.01)
*E05B 1/00* (2006.01)

(52) U.S. Cl. ..... 292/340; 49/504; 49/460

(58) Field of Classification Search ..... 292/340, 292/346; 5/10, 514, 574, 717.01, 717.06; 49/460, 462, 504
See application file for complete search history.

(56) References Cited

U.S. PATENT DOCUMENTS 4,635,399 A * 1/1987 Gehrke et al. ..... 49/460
4,858,384 A * 8/1989 Blankenship ..... 49/460
5,070,650 A * 12/1991 Anderson ..... 49/460
5,566,509 A * 10/1996 Long ..... 49/462
6,085,465 A * 7/2000 Olberding et al. ..... 49/460
6,176,527 B1 * 1/2001 Bench ..... 292/340
2003/0062731 A1 * 4/2003 Richmond et al. ..... 292/346
2003/0159361 A1 * 8/2003 Yeremian ..... 49/504

OTHER PUBLICATIONS

U.S. Appl. No. 11/803,301, filed May 2007, Canardy

* cited by examiner

*Primary Examiner* — Carlos Lugo
*Assistant Examiner* — Alyson M Merlino
(74) *Attorney, Agent, or Firm* — David J. Kreher

(57) ABSTRACT

An apparatus for reinforcing door jambs to prevent forced entry through the doorway by strengthening the composite materials of the door jamb with the addition of the apparatus, which is attached with threaded fasteners that go through the door jamb and are anchored into the framing studs. The device is made of 14 gauge ASTM, A-36, Mild Steel with holes through which the latching and locking mechanisms of the door may pass, as well as smaller beveled holes to pass screws through to attach the device to the door jamb and framing studs. The device is also formed so as to facilitate latching mechanism closure. This device can also be used to assist in the repair of damaged door jambs by holding together the damaged portions once they are placed back in position.

9 Claims, 5 Drawing Sheets

DOOR JAMB ENFORCER

This application is a continuation in part of U.S. patent application Ser. No. 11/803,301 filed May 14, 2007 now abandoned. The benefit of the earlier filing date of the aforementioned U.S. patent application Ser. No. 11/803,301 is hereby claimed.

AMENDED CROSS-REFERENCE TO RELATED APPLICATIONS

| | | |
|---|---|---|
| Patent Application No. 11/803,301 | May, 2007 | Canardy |
| US 2003/0159361 | August, 2003 | Yeremain |
| US 2003/0062731 | April, 2003 | Richmond et al. |
| 5,566,509 | October, 1998 | Long |
| 5,070,650 | October, 1990 | Anderson |
| 6,085,465 | August, 1998 | Olberding et al. |
| 8,858,384 | May, 1988 | Blankenship |
| 4,635,399 | April, 1985 | Gehrke et al. |
| 6,176,527 | May, 1999 | Bench |

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC

Not Applicable

DESCRIPTION

1. Field of the Invention

This apparatus relates to the reinforcement of doorways to prevent damage to and forced entry through the doorway by anchoring the apparatus to the framing studs of the wall, which are structural part of the building in which the door resides and define the location of the door, with the use of threaded fasteners, while facilitating the manual movement of the closure. The apparatus is inserted in the doorway door jamb by attachment to the framing studs and possesses the means particularly adapted for cooperation with opening or closing movement of a door latching mechanism. The nature of the apparatus allows for the latching and locking mechanisms of the door to pass through the apparatus. The apparatus assists in restraining the latching and locking mechanisms by increasing the overall strength of the door jamb through the addition of the apparatus which is anchored all the way through the door jamb to the framing studs with the use of threaded fasteners. This increases the amount of material that would need to be strained before the door jamb would give way in the event that the bolt is forced back by extraneous means. In addition, the apparatus prevents damage to the closure. The apparatus can also be used to repair damaged door jambs by holding the damaged parts together while strengthening the damaged region.

The apparatus specifically addresses deficiencies of prior art in the area by offering an alternative means to reinforce the door, while facilitating the latching mechanism of the door, allowing for easy installation, and does not require disassembly of the decorative molding or destruction of existing wallboard.

2. Background of the Invention

The apparatus was developed to counteract the growing threat of break-ins which are made easier by the abundant use of pre-hung entry doors with wooden jambs. Many of the jambs are built from forger jointed wood which is not sturdy enough to withstand a forced entry blow, especially to the area in and around the latching and locking mechanisms.

Several attempts have been made to develop a reinforcing mechanism for door jambs but all involve either reinforcement of the door by extending a plate around the edge of the door jamb from the locking and latching mechanisms receiving edge, the attachment of multiple pieces to the door jamb, the interference with the easy operation of the door's latching and locking mechanisms, or the disassembly and reassembly of the decorative molding and/or wallboard for proper installation.

In U.S. Pat. App. 20030159361, Yeremian discloses a reinforced door jamb where two plates are used to reinforce the door. Installation of the plates involves cutting open the wallboard to expose the interior side of the door jamb. The decorative molding and wallboard must be removed in order to attach the plates for reinforcing the door latch and bolt.

In U.S. Pat. App. 20030062731, Richmond et al. discloses an L-shaped elongated piece of steel which is secured to the door jamb area by removing the decorative molding and attaching tabs which comprise one part of the L-shaped elongated piece to the wall. The other portion of the L-shaped elongated piece protects the door jamb area that receives the latching and locking bolts.

In U.S. Pat. No. 5,070,650, Anderson discloses two elongated metal plates, the first to be mounted to the door jamb latch and lock bolt receiving portion, while the second plate overlays the first plate and forms an "L" shape so that it is fitted beneath the decorative molding. Anderson's apparatus reinforces the door frame because of the "L" shape which requires the removal of the wallboard from around the door frame, as well as the door jamb, in order to achieve a forced entry. Anderson does not teach that the screws used to attach the plates in place add any structural integrity to the apparatus and may require the decorative molding be detached in order to facilitate installation.

In U.S. Pat. No. 5,566,509, Long discloses an elongated L-shaped piece of steel which is attached to the door jamb latch and lock bolt receiving portion of the door jamb, where the L-shaped portion is bent around the edge of the door jamb toward but not underneath the decorative molding. With this disclosure, and other L-shaped disclosures, the door is prevented from closing properly because the latching mechanism is not fed into the latch receiving portion of the door jamb as the door approaches the door jamb but instead rams against the L-shaped portion. In addition, given that the distance between the edge of the door jamb and the decorative molding may not be consistent, in order for Long's description to be accurate, the short leg portion may need to be modified in order not to interfere with the decorative molding.

In U.S. Pat. No. 6,085,465, Olberding discloses a striker plate that includes a projection from the plate that extends from the plate against the outside edge of the door jamb along the wall thus increasing the strength of the door jamb by requiring the force to open the door to exceed the strength of the material around the receiving hole, the edge of the door jamb and that portion of the wall beneath the projection. The reinforcement over the projection adds additional resistance against the force by increasing the area along the outside wall that must also be removed before the door may be forced open. To install this system, the decorative molding and wallboard must be removed from the existing door frames, then a reinforcement plate is installed over the framing studs, with wallboard and decorative molding being reinstalled after the system's installation. Olberding does not teach that the screws used to attach the system to the door jamb penetrate through to the framing studs or that the screws provide any added reinforcement to the system.

In U.S. Pat. No. 6,085,465, Olberding et al. in view of U.S. Pat. No. 5,070,650, Anderson, a single metal plate with a front face, back face, formed portion and angled portion is disclosed wherein the apparatus may be anchored to the framing studs. However, Olberding in view of Anderson requires that the angled portion be present to supply the actual resistant force from the forced entry of the doorway. In the present invention as claimed, the angled portion is not necessary to supply the additional resistant force, thus distinguishing the present invention as claimed from Olberding in view of Anderson.

In U.S. Pat. No. 4,858,384 Blankenship discloses and "L" shaped reinforcement plate that overlaps the inside of a door jamb and the front of a door jamb. Blankenship teaches only to anchoring to the door jamb and not to the framing studs.

In U.S. Pat. No. 4,635,399 Gehrke discloses a door jamb support includes an L-shaped reinforcing plate with adjustment features to enable the reinforcing support plate to accommodate variances in the design of and in the position of door handle latches in doors. Gehrke does not teach to anchoring the reinforcing plate to the framing studs.

In U.S. Pat. No. 6,176,527 Bench discloses a locking mechanism and a receiver to the bolt from the locking mechanism. The receiver is a tube that extends into the masonry surrounding the door frame. The increased resistance to forced entry is derived from the receiver penetrating into the surrounding masonry. Bench does not teach to reinforcing the door frame itself and only teaches to masonry structures.

SUMMARY OF THE INVENTION

An apparatus for reinforcing door jambs to prevent forced entry through the doorway by strengthening the composite materials of the door jamb. The composite materials are strengthened through the addition of the apparatus as well as the anchoring of the apparatus through the door jamb and into the framing studs with the use of threaded fasteners. The preferred embodiment of the apparatus is made of 14 gauge ASTM, A-36, Mild Steel with rectangular holes through which the latching and locking mechanisms of the door may pass, as well as smaller beveled fastening holes into which threaded fasteners attach the apparatus to the door jamb by passing through the door jamb into the framing studs. Installation of the apparatus does not require the removal of or interfere with the decorative molding or wallboard surrounding the doorway. Further, the apparatus is also formed so as to facilitate door latching mechanism closure. This apparatus can also be used to assist in the repair of damaged door jambs by securing the damaged portions once they are placed back in position.

AMENDED DETAILED DESCRIPTION OF THE INVENTION

Figure 1:
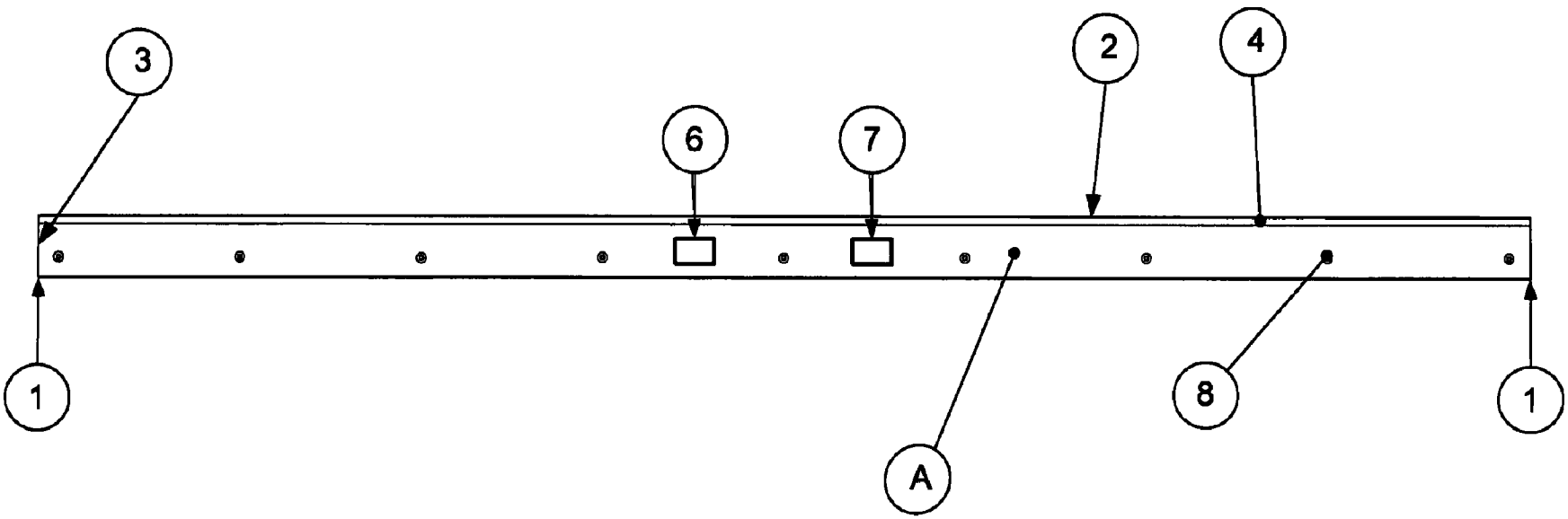
FIG. 1 is a front elevational view of the apparatus, displaying the preferred embodiment of the larger, rectangular holes through which the latching and locking mechanisms of the door pass as well as the locations of the smaller, beveled fastening holes used to attach the device to the door jamb.
Figure 2:
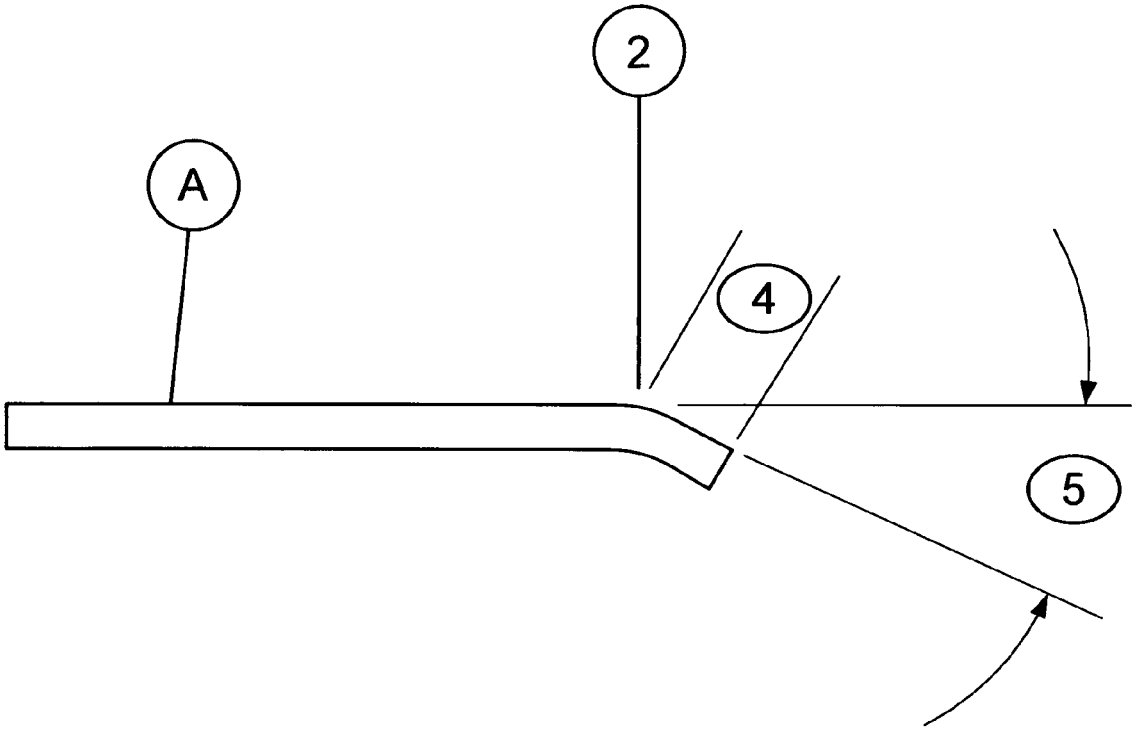
FIG. 2 is an end elevational view of the apparatus, displaying the preferred embodiment of the angle of the formed edge relative to the rest of the apparatus.
Figure 3:
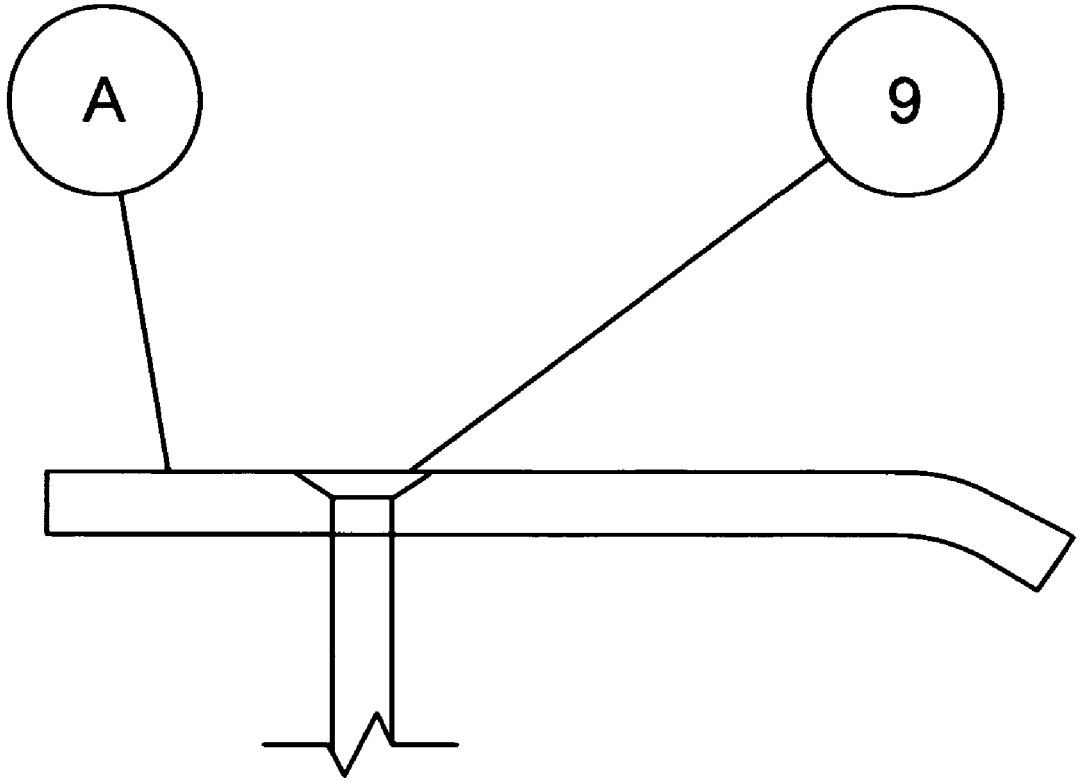
FIG. 3 is an enlargement of one of the fastening holes, displaying the beveled nature of each.

An apparatus A to prevent forced entry consisting of: a single piece of resistant material, front face, back face, a formed edge that bends in from the plane of the rest of the front face, fastening holes to allow the attachment of the apparatus to the door jamb by passing through the door jamb into the framing studs, which are a structural part of the building in which the door resides and define the location of the door, and rectangular holes through the apparatus to allow the latching and locking mechanisms to pass through. The preferred embodiment of the apparatus, as detailed in FIG. 1, consists of a single piece of 14-gauge ASTM, A-36, Mild Steel, with length edges 1 and 2 equal to 47.25 inches and a width equal to 1.93 inches 3. Preferred measurements were chosen based on standard entry doorway measurements. However, the apparatus could also be made out of wood, iron, aluminum, copper, brass, silicon, or plastic with a thickness between 0.05 inches and 0.5 inches, a length between 6 inches and 90 inches, and width 0.5 inches and 3 inches. A formed portion 4 is angled out of the plane of the rest of the front face at an angle 5 between 5° and 85°, preferably 30° and located between 0.1 inches and 1 inch in from length edges 2, preferably 0.25 inches. There are two rectangular holes 6 and 7 of a size appropriate through which a latching or locking mechanism is allowed to pass. The rectangular holes 6 and 7 are spaced equal distance from the center of the entire length of the apparatus such that the rectangular holes match with the latching or locking mechanisms of the door. The apparatus's composition material is maximized between the length opposite the inner length edge 1 of the formed portion 4, the rectangular holes 6 and 7, and the form 4, to maximize the material on either side of rectangular holes 6 and 7. There are also nine smaller fastening holes 8, with each fastening hole centered between the length opposite the form 2 and form 4. Fastening holes 8 being large enough to allow the threaded portion a threaded fastener to pass through and each fastening hole having a beveled edge 9 on the front face of the apparatus to allow the top of the threaded fastener head to rest flush with the apparatus when the threaded portion has passed through fastening holes 8, through the door jamb 14 and into the framing studs 15. Fastening holes 8 nearest to the ends of length edges 1, 2 are located 0.625 inches from the end to the edge of the fastening holes 8. The remaining fastening holes 8 are spaced equally along the remaining length.

The apparatus is made by form pressing a piece of 14-gauge ASTM, A-36, Mild Steel 4 of the appropriate length to shape it and create rectangular holes 6 and 7 and fastening holes 8 as detailed in the preferred embodiment. Then, the apparatus is either coated with a desired color using powder-based paint or left uncoated.

Figure 4:
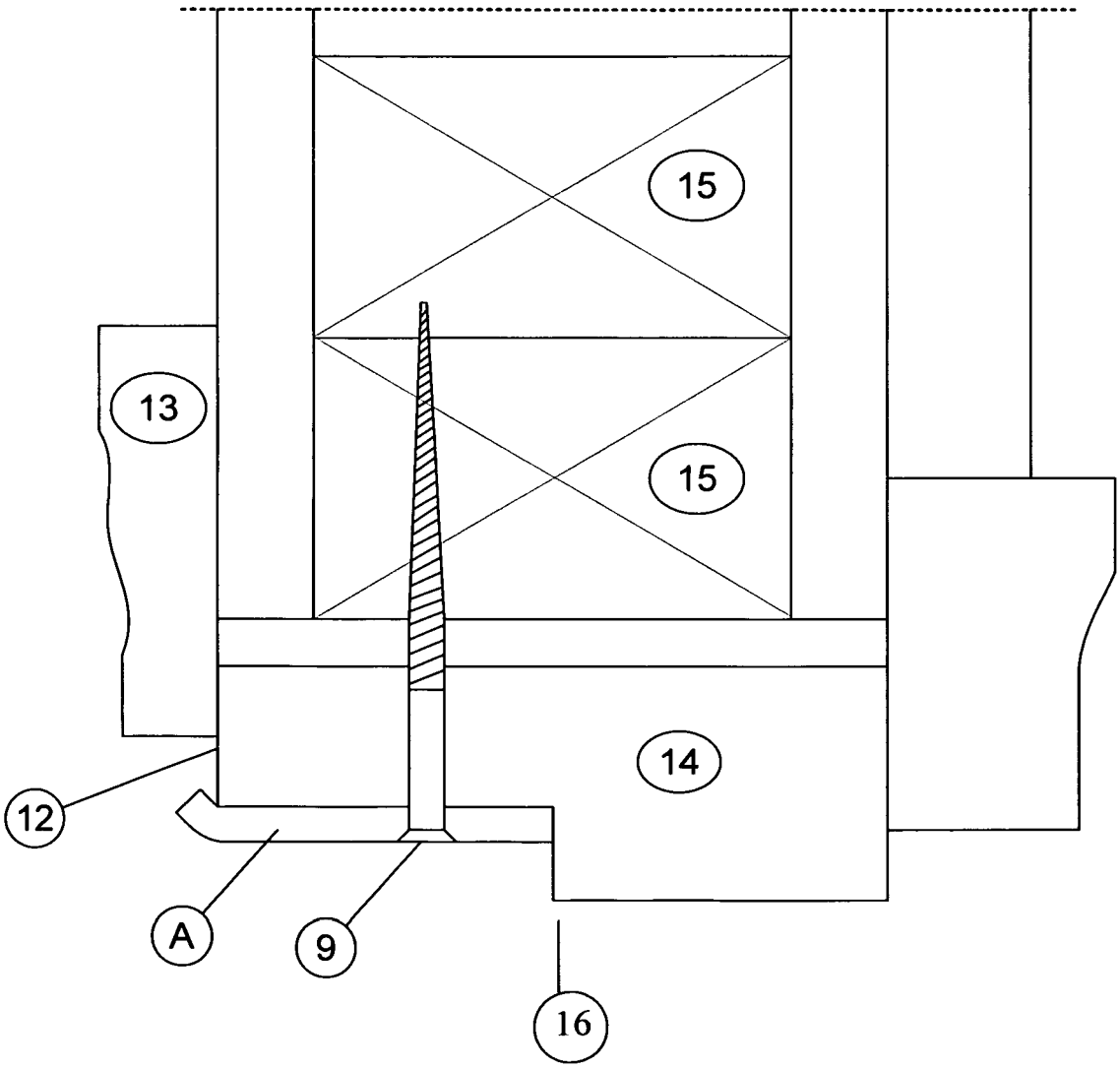
FIG. 4 is a perspective cut-away view of the apparatus located on a door jamb which shows the relationship of the apparatus with the door jamb, how the threaded fasteners penetrate through the door jamb and into the framing studs, and how the apparatus is designed so that upon installation the decorative molding does not need to be removed, the apparatus is not inserted or installed beneath decorative molding and the apparatus does not interfere with the decorative molding such that the decorative molding would need to be modified in order to allow for proper installation of the apparatus.
Figure 5:
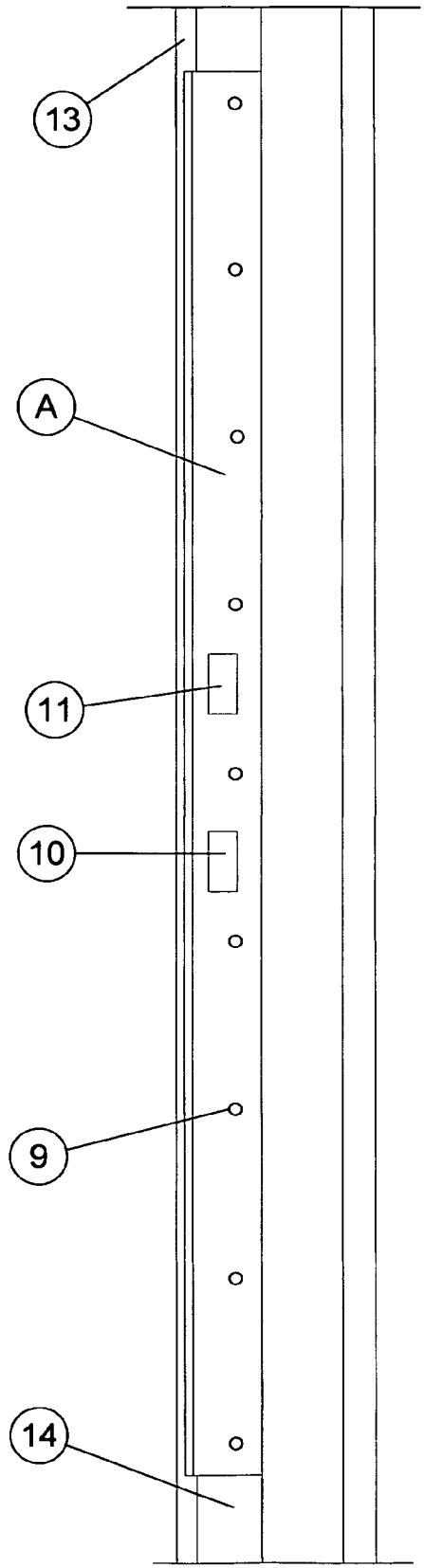
FIG. 5. is a perspective cut-away view of the apparatus as installed on a door jamb which shows the relationship of the apparatus with the exterior wood jamb and interior trim.

The apparatus is attached to a door jamb 14 along the latching or locking mechanism receiving side of the door jamb 14, abutting the door jamb stop 16, using threaded fasteners, typically 3 inch #8 beveled flathead screws (See FIG. 4) that are used to penetrate through the door jamb 14 and into the framing studs 15. The mounting of the apparatus to the door jamb is accomplished by first aligning the latching 10 and locking 11 holes in the door jamb with rectangular holes 6 and 7 of the apparatus, where the formed portion of the apparatus is aligned with the outer edge 12 of the door jamb, to angle away from the door opening and toward the decorative molding 13. The formed portion 4 does not interfere with the decorative molding 13 and therefore the decorative molding does not need to be removed or altered during installation of the apparatus. Next, mark the locations of the fastening holes 8 on the door jamb 14. The apparatus is then removed and the marked fastening hole locations 8 are pre-drilled to prevent the door jamb 14 and framing studs 15 from splitting. Once the fastening hole locations 8 are pre-drilled, the apparatus is again placed against the door jamb, aligning the rectangular holes 6 and 7 with latching 10 and locking 11 holes in the door jamb 14 as well as the pre-drilled holes in the door jamb with fastening holes 8. Threaded fasteners 9 are then hand tightened through fastening holes 8 in the apparatus through the door jamb 14 and into the framing studs 15. If the door does not completely close after installation, the threaded fasteners 9 are further hand tightened, to allow the apparatus to compress the wood of the door jamb which will make additional space to allow for door closure.

What is claimed:

1. An apparatus to prevent forced entry consisting of: a single formed plate with a front face, a back face, length edges, a formed portion along the length of the plate for guiding a latching and locking mechanism into a respective rectangular hole and a plurality of fastening holes to allow the attachment of the apparatus to a latching and a locking mechanism receiving side of a door jamb and framing studs beneath, which are structural parts of the building in which a door resides and define the location of the door, with the use of threaded fasteners long enough to penetrate through the door jamb into the framing studs so as to add additional structural strength to the door jamb;

said formed portion is located between 0.1 inches and 1 inch from one of said length edges, and is angled away from the plane of the front face at an angle of between 5° and 85°, so as not to make an L-shaped apparatus;

whereby said rectangular holes allow the latching and the locking mechanism to pass through are located at the center of the length of the apparatus and spaced sufficiently from one of the length edges opposite of an interior portion of the formed portion and the interior portion of the formed portion, with as much apparatus material as possible on either side of the rectangular holes;

whereby said plurality of fastening holes are centered between one of the length edges opposite the interior portion of the formed portion and the interior portion of the formed portion, wherein each fastening hole is beveled in on the front face side to allow the top of a threaded fastener head to be flush with the apparatus when a threaded portion of each fastener has passed through each fastening hole; and where the fastening holes nearest the ends of the length of the apparatus are at least 0.1 inches from the ends, while the remaining fastening holes are spaced equally along the remaining length;

and whereby said threaded fasteners used to attach the apparatus through the door jamb and into the framing studs are screws with the threaded fastener head being a beveled flat head such that the head of each threaded fastener, when holding the apparatus to the door jamb, is flush with the surface of the apparatus, with a diameter of each threaded fastener being small enough to pass through each fastening hole but with the head being large enough so that the threaded fastener does not pass entirely through each fastening hole.

2. The apparatus of claim 1 wherein the apparatus is a single piece, made up of a resistant material such as wood, iron, steel, aluminum, copper, brass, silicon, or plastic.

3. The apparatus of claim 2 wherein the thickness of the apparatus is between 0.05 inches and 0.5 inches.

4. The apparatus of claim 3 wherein the length of the apparatus is between 6 inches and 90 inches.

5. The apparatus of claim 4 wherein the width of the apparatus is between 0.5 inches and 3 inches.

6. The apparatus of claim 1 wherein the thickness of the apparatus is between 0.05 inches and 0.5 inches.

7. The apparatus of claim 6 wherein the length of the apparatus is between 6 inches and 90 inches.

8. The apparatus of claim 7 wherein the width of the apparatus is between 0.5 inches and 3 inches.

9. The apparatus of claim 1, wherein one of said length edges opposite the interior portion of the formed portion aligns with an inside edge of a door jamb stop, with an edge of the formed portion being angled away from the doorway.

* * * * *